US008704608B1

(12) United States Patent
Chen et al.

(10) Patent No.: US 8,704,608 B1
(45) Date of Patent: Apr. 22, 2014

(54) INTEGRATED CIRCULATOR FOR PHASED ARRAYS

(71) Applicant: The Boeing Company, Chicago, IL (US)

(72) Inventors: Ming Chen, Bellevue, WA (US); Jimmy S. Takeuchi, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 13/730,682

(22) Filed: Dec. 28, 2012

Related U.S. Application Data

(62) Division of application No. 13/007,947, filed on Jan. 17, 2011, now Pat. No. 8,344,820.

(51) Int. Cl.
*H01P 1/32* (2006.01)

(52) U.S. Cl.
USPC ..... 333/1.1; 333/24.2

(58) Field of Classification Search
USPC ..... 333/1.1, 24.2
See application file for complete search history.

(56) References Cited

U.S. PATENT DOCUMENTS

| | | | | |
|---|---|---|---|---|
| 3,733,563 | A * | 5/1973 | Poirier | 333/1.1 |
| 5,185,587 | A | 2/1993 | Kurian et al. | |
| 6,563,394 | B1 | 5/2003 | Kudo et al. | |
| 6,867,661 | B2 | 3/2005 | Dawn et al. | |
| 7,256,661 | B2 | 8/2007 | Chen et al. | |
| 7,495,521 | B2 | 2/2009 | Chen et al. | |
| 2001/0028280 | A1 * | 10/2001 | Maruhashi et al. | 333/1.1 |
| 2002/0135434 | A1 | 9/2002 | Emanuelsson | |
| 2002/0190808 | A1 | 12/2002 | Paquette et al. | |
| 2006/0139118 | A1 | 6/2006 | Vaughn et al. | |
| 2006/0152296 | A1 * | 7/2006 | Pietig | 333/1.1 |

OTHER PUBLICATIONS

Chen et al., USPTO U.S. Appl. No. 13/007,947, filed Jan. 17, 2011, 32 pages.

* cited by examiner

*Primary Examiner* — Stephen Jones
(74) *Attorney, Agent, or Firm* — Yee & Associates, P.C.

(57) ABSTRACT

A circulator/isolator assembly is disclosed. The assembly includes a first magnetic substrate having first surface and a second surface and a first ground plane formed on the first surface. A dielectric layer is disposed adjacent first magnetic substrate. The dielectric layer includes a multi-port junction circuit coupled to transmission traces. One of the traces forms an input port and another forms an output port. A first magnet is disposed proximate the multi-port junction circuit of the dielectric layer. The first magnet excites a circular, unidirectional magnetic flux field in the first magnetic substrate that limits electromagnetic wave propagation to a single direction.

12 Claims, 6 Drawing Sheets

INTEGRATED CIRCULATOR FOR PHASED ARRAYS

This application is a divisional application of U.S. patent application Ser. No. 13/007,947, filed Jan. 17, 2011, now U.S. Pat. No. 8,344,820, issued on Jan. 1, 2013.

BACKGROUND

The subject matter described herein relates to circulators and isolators used in RF devices, and more particularly to an integrated circulator or isolator having a packaging configuration suited for use with phased array antenna systems and other RF devices where space and packaging limitations preclude the use of conventional circulators or isolators.

In phased array antennas, radar systems and various other forms of electronic sensor and communications systems or subsystems, ferrite circulators and isolators provide important functions at RF front end circuits of such systems. Typically, such devices, which can be broadly termed "non-reciprocal electromagnetic energy propagation" devices, are used to restrict the flow of electromagnetic wave energy to one direction only to/from an RF transmitter or RF receiver subsystem. Circulators and isolators can also be used for directing transmitting and receiving electromagnetic energies into different channels and as frequency multiplexers for multiband operation. Other applications involve protecting sensitive electronic devices from performance degradation or from damage by blocking incoming RF energy from entering into a transmitter circuit.

A conventional microstrip circulator device consists of a ferrite substrate with RF transmission lines metalized on the top surface to form three or more ports. A ground plane is typically formed on the backside of the substrate, as illustrated in FIGS. 1 and 2. An isolator is simply a circulator with one of the three ports terminated by a load resistor.

A circulator device uses the gyromagnetic properties of the ferrite material, typically yttrium-iron-garnet (YIG), for its low loss microwave characteristics. The ferrite substrate is biased by an external, static magnetic field from a permanent magnet. The magnetic lines of flux in the ferrite substrate propagate in only one circular direction, thus forming a non-reciprocal path for electromagnetic waves to propagate, as indicated by arrows in FIG. 1. The higher the operating frequencies, however, the stronger the biasing field that is required, which necessitates a stronger magnet.

A phased array antenna is an antenna formed by an array of individual active module elements. In applications involving phased array antennas, each radiating/reception element can use one or more such ferrite circulators or isolators in the antenna module. However, incorporating any device into the already limited space available on most phased array antennas can be an especially challenging task for the antenna designer. The space limitations imposed in phased array antennas is due to the fact that the spacing of the radiating/reception elements of the array is determined in part by the maximum scan angle that the antenna is required to achieve, and in part by the frequency at which the antenna is required to operate. For high performance phased array antennas, this spacing is typically close to one half of the wave length of the electromagnetic waves being radiated or received. For example, a 20 GHz antenna would have a wavelength of about 1.5 cm or 0.6 inch, thus an element spacing of merely 0.75 cm or 0.3 inch. This spacing only gets smaller as the antenna operating frequency increases. Thus, a conventional circulator device (e.g., a conventional microstrip circulator) has physical size constraints in all 3 dimensions due to its having a ferrite substrate with metalized RF transmission lines on the substrate and a permanent magnet attached therewith.

As a consequence, a conventional microstrip circulator/isolator requires mounting on a phased array module circuit board made of a non-magnetic substrate material totally different from that of the ferrite substrate. Complicating matters further, the size of the ferrite circulator/isolator does not scale down as the operating frequency increases because of the need for a stronger permanent magnet with the increasing operating frequency. The need for a stronger permanent magnet is harder to meet due to material constraints. Furthermore, wire bonding connections are required for connecting conventional circulator/isolator ports with the rest of a microwave circuit. Accordingly, the packaging of a conventional circulator/isolator becomes more and more difficult and challenging within phased array antennas as the operating frequency of the antenna increases or its performance requirements (i.e., scan angle requirement) increases. These same packaging limitations are present in other forms of RF devices where there is simply insufficient space to accommodate a conventional circulator or isolator.

Accordingly, circulator/isolator assemblies may find utility in RF communication applications.

SUMMARY

In one aspect, a circulator/isolator assembly is disclosed that includes a first magnetic substrate having a first surface, a second surface, and a first ground plane formed on the first surface. A dielectric layer is disposed adjacent first magnetic substrate. The dielectric layer includes a multi-port junction circuit coupled to one or more RF transmission traces. One of the traces forms an input port and another of (different one of) the traces forms an output port. In one embodiment, a first magnet is disposed proximate the multi-port junction circuit of the dielectric layer. Continuing with this embodiment, the first magnet excites a circular, unidirectional magnetic flux field in the first magnetic substrate to limit electromagnetic wave propagation to a single direction of the multi-port circuit junction.

In another aspect, an antenna assembly is disclosed. The assembly includes a first radiating element, a second radiating element, and a circulator/isolator assembly includes a first magnetic substrate having first surface and a second surface and a first ground plane formed on the first surface. In one exemplary embodiment, a dielectric layer is disposed adjacent the first magnetic substrate. In another embodiment, the dielectric layer includes a multi-port junction circuit coupled to RF transmission traces and one of the traces forms an input port and another forms an output port. Continuing with this embodiment, a first magnet is disposed proximate to the multi-port junction circuit of the dielectric layer. In one variant, the first magnet excites a circular, unidirectional magnetic flux field in the first magnetic substrate to limit electromagnetic wave propagation to a single direction of the multi-port circuit junction.

In another aspect, a method to channel one or more communication signals through a transmit/receive module in a wireless communication system comprises receiving one or more communication signals in the transmit/receive module and passing the communication signal through at least one communication channel comprising a circulator/isolator assembly. The circulator/isolator assembly comprises a first magnetic substrate having a first surface and a second surface and a first ground plane formed on the first surface, a dielectric layer disposed adjacent the first magnetic substrate, the dielectric layer comprising a multi-port junction circuit coupled to a plurality of RF transmission traces, one of the traces forming an input port and a different one of said traces forming an output port, and a first magnet disposed proximate the multi-port junction circuit of the dielectric layer, such that the first magnet excites a circular, unidirectional magnetic flux field in the first magnetic substrate that limits electromagnetic wave propagation to a single direction of the multi-port circuit junction circuit.

In another aspect, a circulator/isolator assembly comprises a first magnetic substrate having a first surface and a second surface and a first ground plane formed on the first surface, a dielectric layer disposed adjacent the first magnetic substrate, the dielectric layer comprising a multi-port junction circuit coupled to a plurality of RF transmission traces, one of the traces forming an input port and a different one of said traces forming an output port, wherein the first magnetic substrate comprises a self-biasing ferrite material.

The features, functions and advantages discussed herein can be achieved independently in various embodiments described herein or may be combined in yet other embodiments, further details of which can be seen with reference to the following description and drawings.

BRIEF DESCRIPTION OF THE DRAWINGS

The detailed description is described with reference to the accompanying figures.

DETAILED DESCRIPTION

In the following description, numerous specific details are set forth to provide a thorough understanding of various embodiments. However, it will be understood by those skilled in the art that the various embodiments may be practiced without the specific details. In other instances, well-known methods, procedures, and components have not been illustrated or described in detail so as not to obscure the particular embodiments.

Various examples of circulator assemblies are described and claimed in commonly assigned U.S. Pat. Nos. 5,256,661 and 7,495,521, both to Chen, et al, the disclosures of which are incorporated herein by reference. In brief, this application describes alternate constructions of circulator assemblies which may be used in phased array antenna structures.

Figure 1:
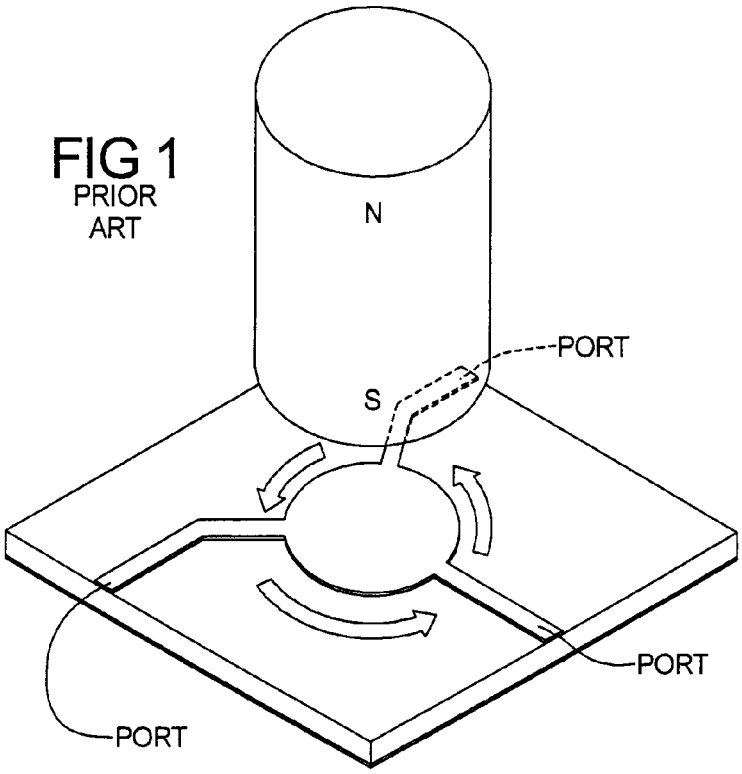
FIG 1 PRIOR ART
FIG. 1 is a top perspective view of a prior art circulator/isolator with a permanent bar magnet shown separated from one surface of a substrate.
Figure 2:
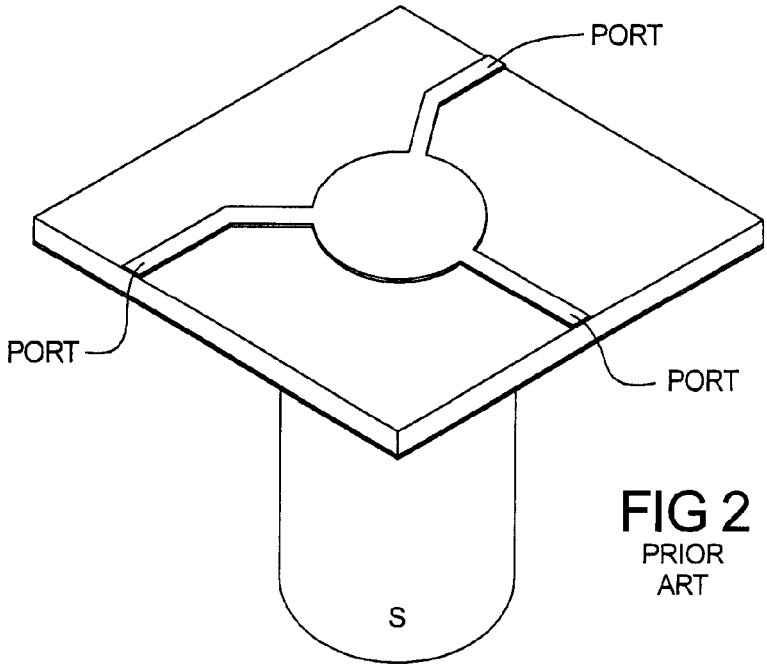
FIG 2 PRIOR ART
FIG. 2. is a bottom perspective view of a prior art circulator/isolator with a permanent bar magnet shown separated from one surface of a substrate.
Figure 2B:
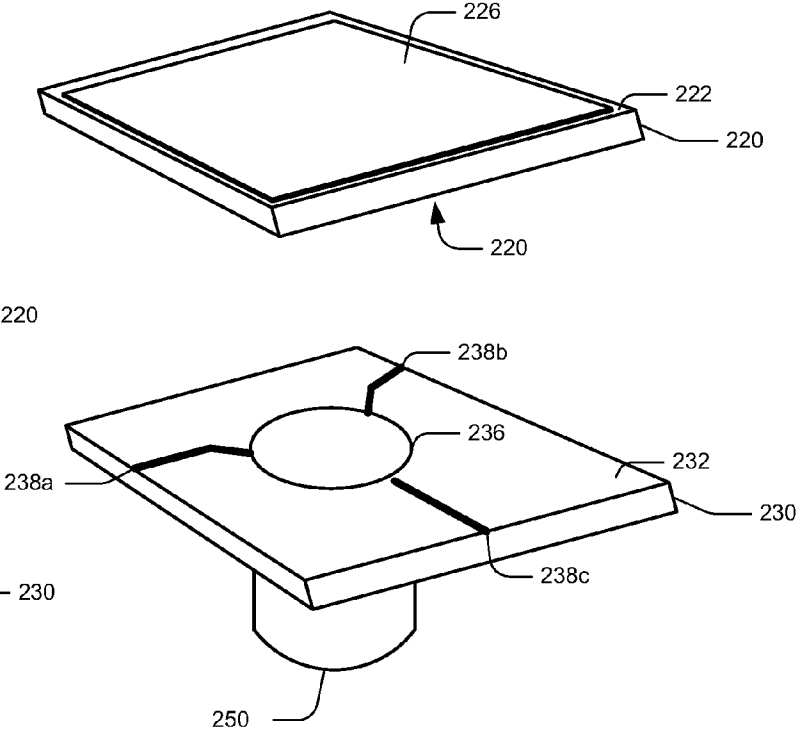
FIGS. 2A-2E are schematic, exploded perspective views of a circulator/isolator assembly in accordance with various embodiments.
Figure 2A:
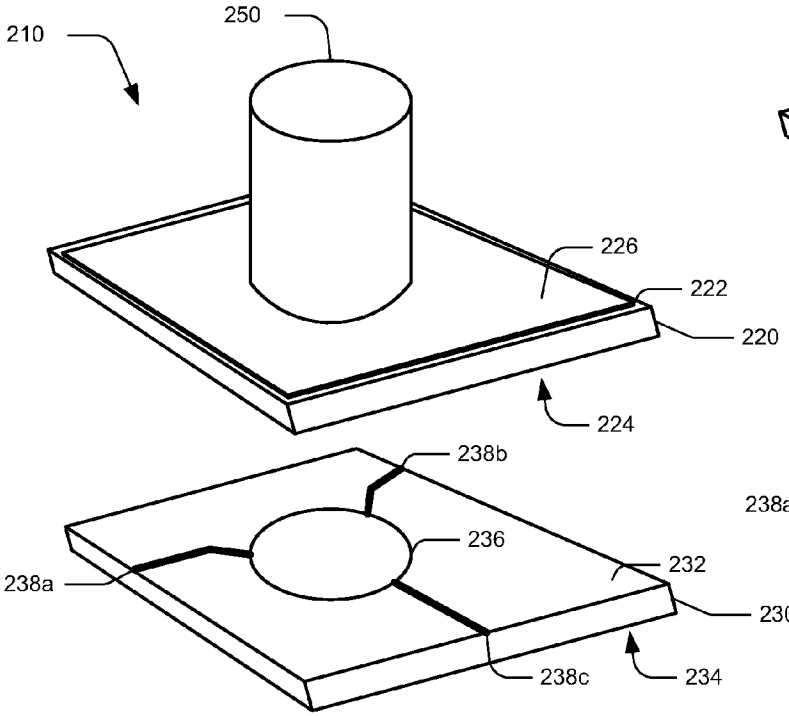

FIGS. 2A-2E are exploded, perspective views of a circulator/isolator assembly 210 in accordance with various embodiments. Referring first to FIG. 2A, in one embodiment a circulator/isolator assembly 210 comprises a first magnetic substrate 220, a dielectric layer 230 comprising a multi-port junction circuit 236 coupled to a plurality of RF transmission traces 238, and a magnet 250 disposed proximate the multi-port junction circuit 236 of the dielectric layer 230.

The first magnetic substrate 220 has first surface 222, which appears as the upper surface in FIG. 2A, and a second surface 224 which appears as the lower surface in FIG. 2A. The first magnetic substrate 220 may vary in dimensions. For instance, in one implementation for the Ku band frequency, the first magnetic substrate 220 measures approximately 0.28 inch (7.1 mm) in length and width and has an overall thickness of approximately 0.02 inch (0.5 mm).

In one embodiment, the first magnetic substrate 220 is formed from a material that comprises yttrium iron garnet ferrite (YIG) substrates that are formed in a planar configuration. Other suitable materials for the first magnetic substrate 220 may include ferrites such as spinel or hexagonal, which are chosen depending on the required operational frequency and other performance parameters. Please note that ferrites exhibit excellent ferromagnetic properties, e.g., susceptible to induction, non-conductive, and low loss materials and that other ferromagnetic materials may also be utilized for the first magnetic substrate 220.

In one embodiment, a top surface 226 includes a first ground plane is formed on the first surface 222 of the first magnetic substrate 220. In some embodiments the top surface 226 includes a ground plane formed as a metalized layer on the first surface 222 of the first magnetic substrate 220. In the embodiment depicted in FIG. 2A the top surface 226 (e.g., a ground plane 226) covers substantially an entirety of the first surface 222 of the first magnetic substrate 220. In alternate embodiments the top surface 226 may only have a ground plane on a portion of the first surface 222 (not shown).

The first magnet 250 may also vary in dimensions depending upon the strength of the magnetic field that is needed. In one embodiment, the magnet 250 has a height of about 0.1 inch (2.5 mm) and a diameter of about 0.1 inch (2.5 mm). While shown as a circular magnet, the first magnet 250 could comprise other shapes such as triangular, rectangular, octagonal, etc. Similarly, the first magnetic substrate 220 and/or the multi-port junction circuit 236 could also comprise other shapes such as triangular, rectangular, octagonal, etc. The magnetic field strength of the magnetic 250 may vary considerably to suit a specific application, but in one implementation is between about 1000 Gauss-3000 Gauss. For millimeter wave applications (30 GHz-60 GHz), the strength of the magnetic field may be as high approximately 10,000 Gauss. Any magnet that can provide such field strengths without affecting the microwave fields (thus being non-conductive) may be utilized. Electromagnets could potentially be used for many applications for reduced magnetic strength requirements. Permanent bar magnets widely available commercially from a number of sources could also be used for many applications.

A dielectric layer 230 is disposed adjacent first magnetic substrate 220. In some embodiments the dielectric layer 230 may be a portion of a printed circuit board (PCB) or any other conventional microwave substrate. By way of example, the dielectric layer 230 may be formed from a polytetrafluoroethylene (PTFE) material or a ceramic-based material such as alumina. The dielectric layer 230 comprises a multi-port junction circuit 236 coupled to a plurality of RF transmission traces 238*a*, 238*b*, 238*c*, which may be collectively referred to herein by reference numeral 238. The end portion of the transmission traces 238 may be considered input/output ports through which RF energy may be transmitted. The multi-port junction circuit 236 and transmission traces 238 may be formed on a surface of the dielectric layer 230 or may be embedded in the dielectric layer 230.

The assembly 210 may be assembled by positioning the first magnetic substrate 220 and the first magnet 250 proximate the multi-port junction circuit 236 of the dielectric layer 230, which may be part of a microwave circuit assembly. The first magnet 250 excites a circular, unidirectional magnetic flux field in the first magnetic substrate 220 that limits electromagnetic wave propagation to a single direction the multi-port circuit junction 236 such that RF energy can flow in only one circular direction (unidirectional) between the ports defined by the RF transmission traces 238.

The assembly 210 shown in FIG. 2A can be configured as an isolator by electrically coupling one or more load resistors (not shown) to one of the ports defined by the RF transmission traces 238. For instance, a load resistor of 50 ohms (not shown) may connect RF transmission trace 238*b* to an electrical ground connection (not shown) to form an RF energy termination port to facilitate, for instance, RF energy circulation from RF transmission trace 238*a* to RF transmission trace 238*c*.

FIG. 2B is a schematic, exploded perspective view of an alternate embodiment of a circulator/isolator assembly 210. The respective components of the assembly 210 depicted in FIG. 2B are the same as the components depicted in FIG. 2A. The principle difference between the embodiments depicted in FIGS. 2A and 2B is that the first magnet 250 is disposed on the second surface 234 of the dielectric layer 230, rather than on the top surface 226 of the first magnetic substrate 220. The assembly 210 may be assembled by positioning the first magnetic substrate 220 and the magnet 250 proximate the multi-port junction circuit 236 of the dielectric layer 230, which may be part of a microwave circuit assembly (e.g., antenna T/R module 700 illustrated in FIG. 4).

Figure 2D:
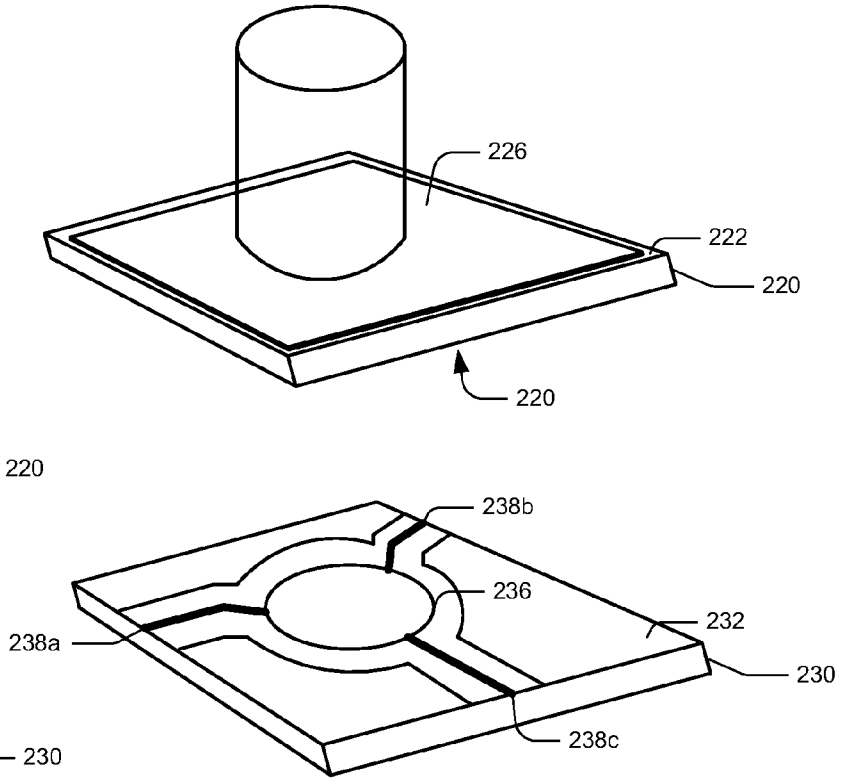
Figure 2C:
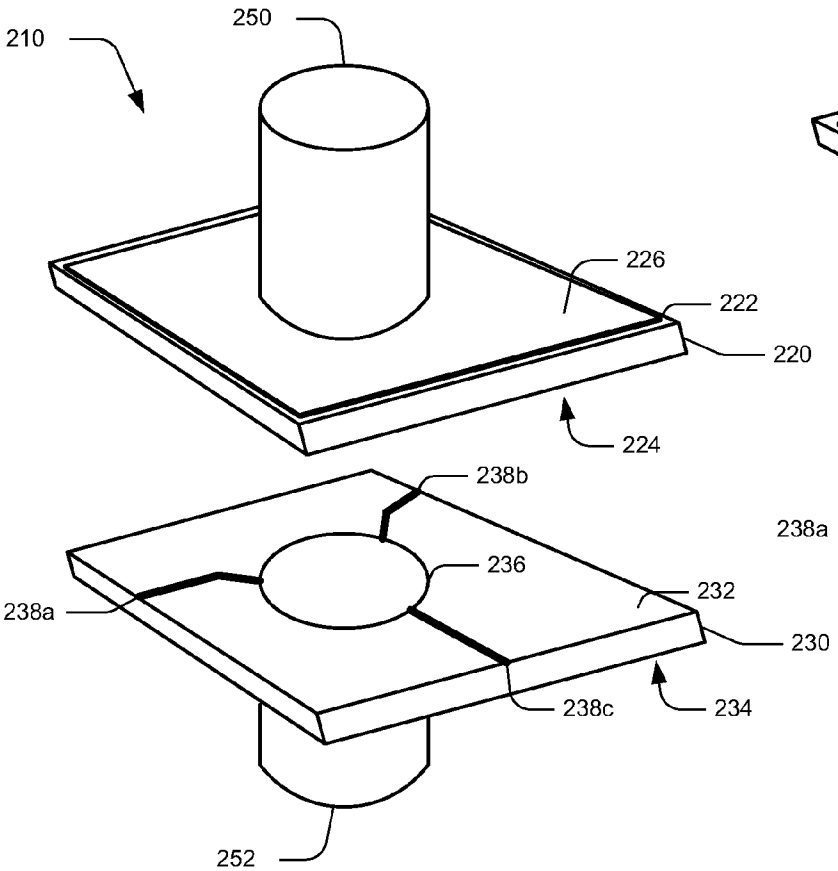

FIG. 2C is a schematic, exploded perspective view of an alternate embodiment of a circulator/isolator assembly 210. The respective components of the assembly 210 depicted in FIG. 2B are the same as the components depicted in FIG. 2A. The principle difference between the embodiments depicted in FIGS. 2A and 2C is the addition of a second magnet 252 disposed on the second surface 234 of the dielectric layer 230. The assembly 210 may be assembled by positioning the first magnetic substrate 220 and the first magnet 250 proximate the multi-port junction circuit 236 of the dielectric layer 230, which may be part of a microwave circuit assembly. Advantageously, the use of two magnets 250, 252 provides a stronger and more uniformly distributed magnetic flux field through the first magnetic substrate 220 and the dielectric layer 230.

FIG. 2D is a schematic, exploded perspective view of an alternate embodiment of a circulator/isolator assembly 210. The respective components of the assembly 210 depicted in FIG. 2D are the same as the components depicted in FIG. 2A. The principle difference between the embodiments depicted in FIGS. 2A and 2D is that the metal traces (traces 238 et. al) and the junction circuit 236 are surrounded by metal ground planes, transforming the microstrip circuit into a co-planar waveguide (CPW) circuit for the circulator.

Figure 2E:
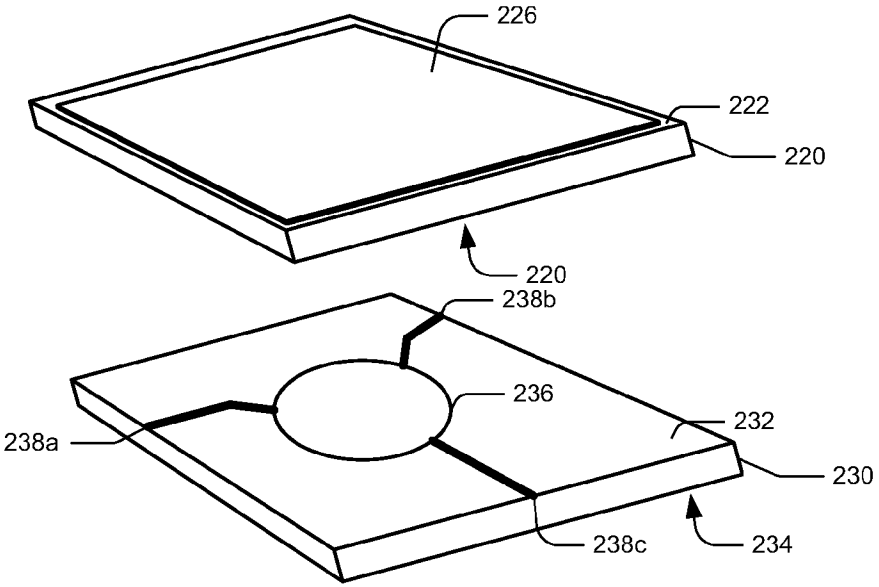

FIG. 2E is a schematic, exploded perspective view of an alternate embodiment of a circulator/isolator assembly 210. Many of the respective components of the assembly 210 depicted in FIG. 2E are the same as the components depicted in FIG. 2D. The principle difference between the embodiments depicted in FIGS. 2D and 2E is that the magnetic substrate 220 may be formed from a self-biasing ferrite material. By way of example, self-biasing ferrite materials may comprise at lest one of a barium ferrite doped with scandium or a hexaferrite material. Incorporating a self-biasing magnetic substrate 220 into the assembly 210 allows the magnet 250 to be omitted from the assembly 210.

Advantageously, as illustrated in FIGS. 2A-2D, the first magnetic substrate 220 does not carry junction circuit traces (e.g., RF circuit traces 238*a*, 238*b*, 238*c*) as do many conventional circulator/isolators. Furthermore, advantageously the circulator/isolator device 210 may have a permanent magnetic positioned on either top (e.g., the magnet 250) and/or the bottom (e.g., the second magnet 252) to provide un-directional energy flow functionality.

Figure 3:
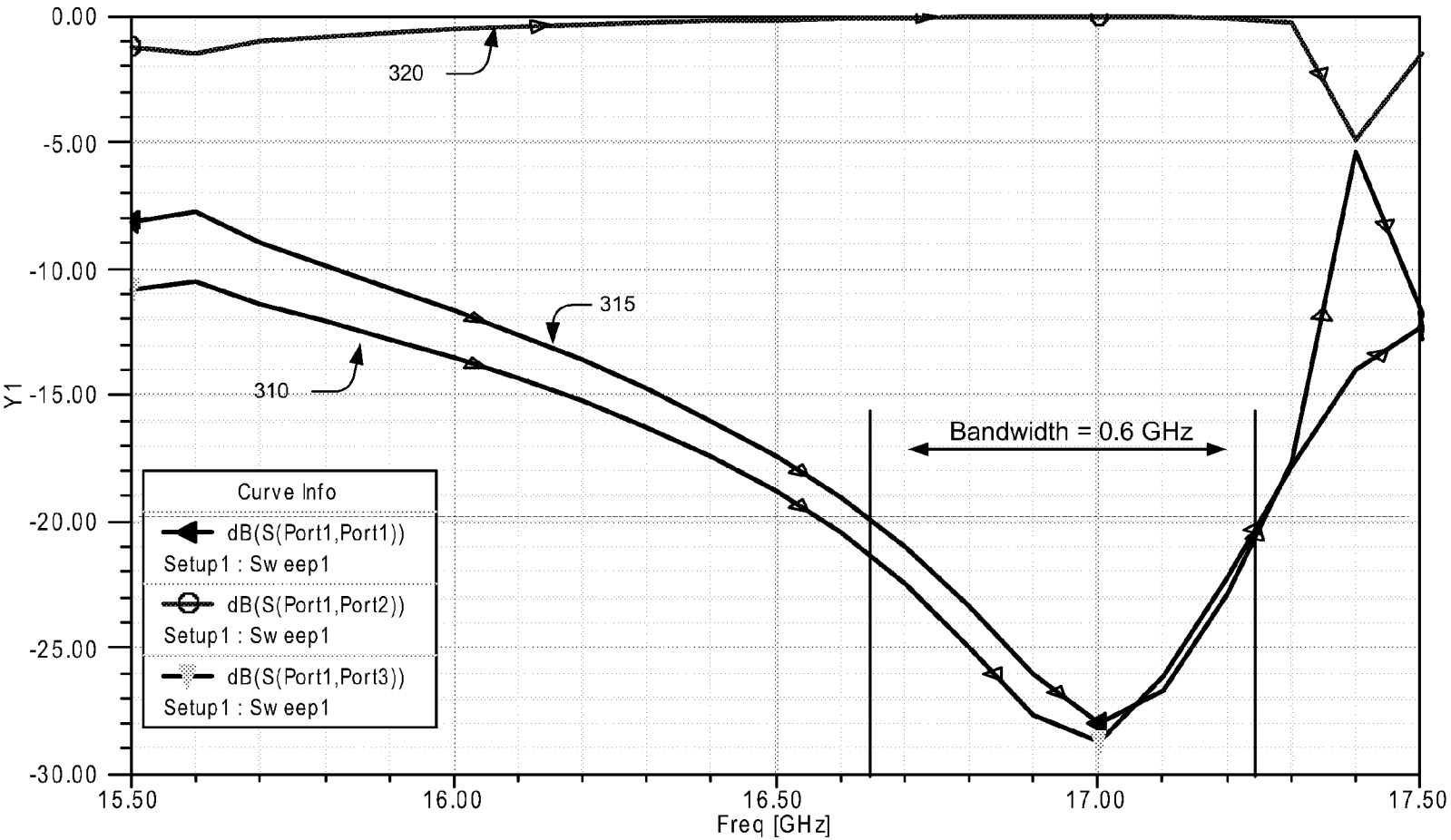
FIG. 3 is a graph illustrating performance parameters of a circulator/isolator assembly in accordance with various embodiments.

FIG. 3 is a graph illustrating simulated performance parameters of a circulator/isolator assembly in accordance with various embodiments described herein. Curve 310 represents the isolation loss, curve 315 represents the return loss, and curve 320 represents the insertion loss, each of which are plotted across a frequency spectrum extending from 15.5 GHz to 17.5 GHz. As illustrated by FIG. 3 the structure obtains near-zero dB insertion loss and an isolation loss and return loss of approximately −20 dB over a frequency range extending from 16.65 GHz to 17.25 GHz.

Figure 4:
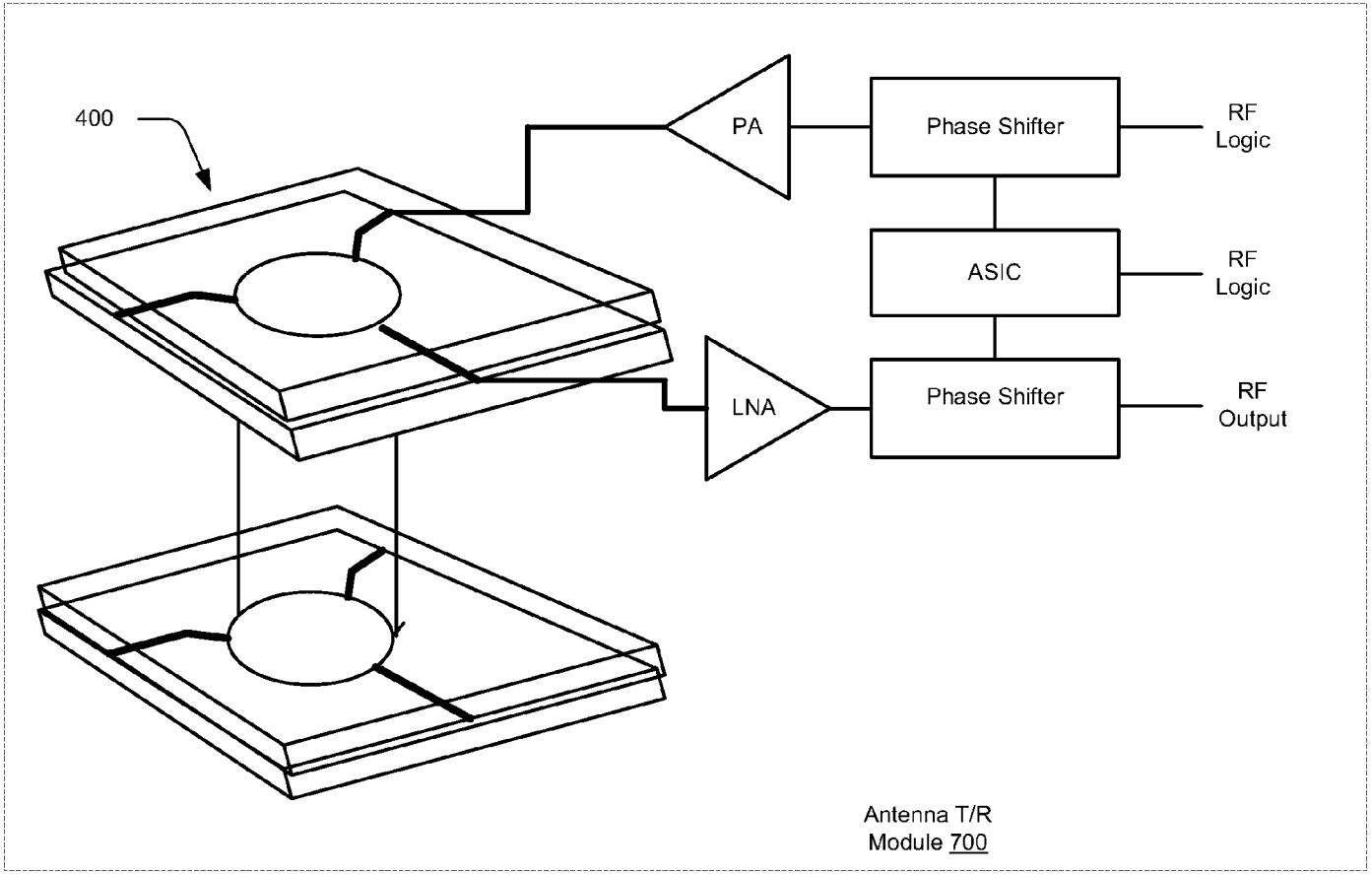
FIG. 4 is a perspective view of a circulator/isolator assembly in accordance with embodiments incorporated into a portion of a multi-channel phased array antenna.

In some embodiments one or more circulator assemblies (e.g., circulator/isolator 210) may be incorporated into a phased array antenna. Referring to FIG. 4, the circulator 400 is illustrated as being implemented in an exemplary phased array antenna transmit and receive (T/R) module 700. The exemplary transmit module illustrates a power amplifier (PA) coupled to a phase shifter operated by an application specific integrated circuitry (ASIC) to produce a RF logic output. The exemplary receive module illustrates a low noise amplifier (LNA) coupled to a phase shifter integrated with an application specific integrated circuit (ASIC) to produce a RF logic output. Please note that the circulator/isolator 400, in practice, is electrically coupled to a pair of radiator elements (not illustrated) to enable an RF T/R channel to be formed in the radiator elements to achieve, for instance, a dual beam antenna pattern or radiation directivity output. Specific phased array antenna embodiments and teachings in the following patents owned by The Boeing Company: U.S. Pat. Nos. 6,714,163; 6,670,930; 6,580,402; 6,424,313, as well as U.S. application Ser. No. 10/625,767, filed Jul. 23, 2003 and U.S. application Ser. No. 10/917,151, filed Aug. 12, 2004, all of which are incorporated by reference into the present application.

Figure 5:
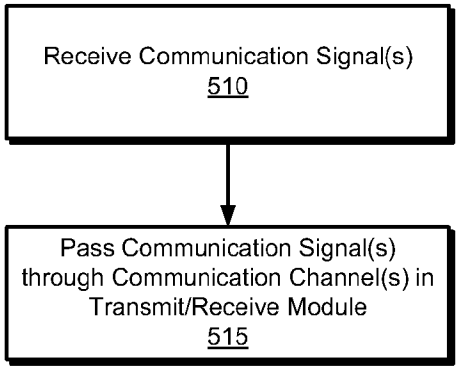
FIG. 5 is flowchart illustrating operations in a method to channel one or more communication signals through a transmit/receive module in a wireless communication system in accordance with various embodiments.

Referring to FIG. 5, a method 500 is disclosed to channel one or more communication signals through a transmit/receive module in a wireless communication system. Referring to FIG. 5, at operation 510 a communication signal is received in a transmit/receive module such as the antenna transmit/receive module 700 depicted in FIG. 4. In some embodiments the communication signal may be a signal received by the antenna from a remote wireless device. In such embodiments the communication signal would be an inbound signal. In other embodiments the communication signal may be generated by circuitry in an electronic device coupled to the antenna transmit/receive module 700, i.e., an outbound signal.

At operation 515 the communication signal is passed through a communication channel in the transmit/receive module which comprises a circulator/isolator assembly. As described herein, the circulator/isolator assembly comprises a first magnetic substrate having a first surface and a second surface and a first ground plane formed on the first surface, a dielectric layer disposed adjacent the first magnetic substrate, the dielectric layer comprising a multi-port junction circuit coupled to a plurality of RF transmission traces, one of the traces forming an input port and a different one of said traces forming an output port, and a first magnet disposed proximate the multi-port junction circuit of the dielectric layer, such that the first magnet excites a circular, unidirectional magnetic flux field in the first magnetic substrate that limits electromagnetic wave propagation to a single direction of the multi-port circuit junction circuit.

Thus, described herein are novel structures for circulator/isolator assemblies which may be used in conjunction with phased array antennas. In accordance with the description provided herein, a circulator/isolator assembly may be constructed with the multi-port junction circuit 236 and the RF traces 238 disposed on the dielectric layer. This enables the multi-port junction circuit 236 and the RF traces 238 to be printed as a component of a circuit board rather than placed separately as a component of the substrate. In addition, this allows the use of a plain substrate layer 220. Advantageously, unlike a conventional circulator having a 3-port Y-junction circuit traces deposited on a ferrite substrate, the novel structure for a circular/isolator (e.g., circulator/isolator assembly 210) shares a same non-magnetic substrate with a printed circuit board containing one or more transmit/receive (T/R) channels. In addition, a ferrite substrate with only a metalized ground plane on one side can now be simply placed on top of a multi-junction circuit (e.g., multi-junction trace) to achieve circulator/isolator functionality, e.g., unidirectional capability. Furthermore, advantageously, the disclosed circulator/isolator combined with prior art patents (e.g., U.S. Pat. No. 7,256,661, U.S. Pat. No. 7,495,521) incorporated by reference in their entirety will provide multi-channel functionality in a compact space; thus, this circulator/isolator device reduces antenna system overall footprint.

One skilled in the art will recognize that connections (e.g., ground connections, RF transmission connections) between the top surface 226 and the second surface 234 may be provided by metalized vias outside of the multi-port junction circuit 236 and RF transmission lines 238 (e.g., RF transmission traces). Alternatively, other mechanisms such as a metal casing wrapping the top surface 226 and the second surface 234 together without getting too close to the ports of 238 so as to provide needed connectivity there between.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment. Each of the steps described in the above method are part of a sample exemplary embodiment. The order, positioning, and break-down of the steps of the above described method are exemplary only, e.g., each of the above disclosed steps are interchangeable, reorderable, replaceable, removable, and combinable. As such, this method is indicative of one exemplary process for manufacturing a circulator/isolator in accordance with the teachings of the specification.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. A circulator/isolator assembly, comprising:

a first magnetic substrate having a first surface, a first ground plane formed on the first surface, and a second surface opposite the first surface;

a single dielectric layer having a first side, the first side disposed adjacent the second surface of the first magnetic substrate, the dielectric layer comprising a multi-port junction circuit coupled to a plurality of RF transmission traces that are either disposed on a surface of the first side of the dielectric layer or embedded in the first side of the dielectric layer, one of the plurality of RF transmission traces forming an input port and a different one of the plurality of RF transmission traces forming an output port, and a ground plane disposed on a second side of the dielectric layer, the second side opposite the first side; and wherein the first magnetic substrate comprises a self-biasing ferrite material.

2. The circulator/isolator assembly of claim 1, wherein the self-biasing ferrite material comprises at least one of:

a barium ferrite doped with scandium; or a hexaferrite material.

3. The circulator/isolator assembly of claim 1, wherein one of the plurality of RF transmission traces is coupled to a load resistor to configure the circulator/isolator assembly to operate as an isolator.

4. The circulator/isolator assembly of claim 1, further comprising at least one ground plane proximate the plurality of RF transmission traces.

5. A method of channeling a communication signal, comprising:

receiving the communication signal in a circulator/isolator assembly comprising a first magnetic substrate having a first surface, a first ground plane formed on the first surface, and a second surface opposite the first surface, wherein the first magnetic substrate comprises a self-biasing ferrite material, wherein a first side of a single dielectric layer is disposed adjacent the second surface of the first magnetic substrate, the dielectric layer comprising a multi-port junction circuit coupled to a plurality of RF transmission traces that are either disposed on a surface of the first side of the dielectric layer or embedded in the first side of the dielectric layer, one of the plurality of RF transmission traces forming an input port and a different one of the plurality of RF transmission traces forming an output port, and a ground plane disposed on a second side of the dielectric layer, the second side opposite the first side; and channeling the communication signal through the plurality of RF transmission traces.

6. The method of claim 5, wherein the self-biasing ferrite material comprises at least one of:

a barium ferrite doped with scandium; or a hexaferrite material.

7. The method of claim 5, wherein the circulator/isolator assembly is configured to operate as an isolator by coupling one of the plurality of RF transmission traces to a load resistor.

8. The method of claim 5, wherein at least one ground plane is proximate the plurality of RF transmission traces.

9. A method of manufacturing a circulator/isolator assembly, comprising:

forming a first ground plane on a first surface of a first magnetic substrate comprising a self-biasing ferrite material, the first magnetic substrate further comprising a second surface opposite the first surface; and disposing a first side of a single dielectric layer adjacent the second surface of the first magnetic substrate, the dielectric layer comprising a multi-port junction circuit coupled to a plurality of RF transmission traces that are either disposed on a surface of the first side of the dielectric layer or embedded in the first side of the dielectric layer, one of the plurality of RF transmission traces forming an input port and a different one of the plurality of RF transmission traces forming an output port, and a ground plane disposed on a second side of the dielectric layer, the second side opposite the first side.

10. The method of claim 9, wherein the self-biasing ferrite material comprises at least one of:

a barium ferrite doped with scandium; or a hexaferrite material.

11. The method of claim 9, further comprising:

configuring the circulator/isolator assembly to operate as an isolator by coupling one of the plurality of RF transmission traces to a load resistor.

12. The method of claim 9, wherein disposing further includes disposing at least one ground plane proximate the plurality of RF transmission traces.

* * * * *